US007626491B2

(12) United States Patent
Yamada et al.

(10) Patent No.: US 7,626,491 B2
(45) **Date of Patent: *Dec. 1, 2009**

(54) INDICATOR CONTROL SYSTEM FOR CONSTRUTION MACHINE

(75) Inventors: Hideo Yamada, Tokyo (JP); Isao Murota, Tokyo (JP); Tomoaki Ono, Tokyo (JP); Satoshi Fujii, Tokyo (JP)

(73) Assignee: Caterpillar Japan Ltd., Tokyo (JP)

( * ) Notice: Subject to any disclaimer, the term of this patent is extended or adjusted under 35 U.S.C. 154(b) by 166 days.

This patent is subject to a terminal disclaimer.

(21) Appl. No.: 10/584,391

(22) PCT Filed: Dec. 16, 2004

(86) PCT No.: PCT/JP2004/018804

§ 371 (c)(1),
(2), (4) Date: Jun. 23, 2006

(87) PCT Pub. No.: WO2005/064091

PCT Pub. Date: Jul. 14, 2005

(65) Prior Publication Data

US 2007/0164873 A1 Jul. 19, 2007

(30) Foreign Application Priority Data

Dec. 25, 2003 (JP) ..... 2003-431632

(51) Int. Cl.
*B60Q 1/00* (2006.01)
*H04N 7/18* (2006.01)
*G08B 21/00* (2006.01)

(52) U.S. Cl. ..... 340/438; 340/461; 340/525; 340/679; 701/50; 348/118; 348/148

(58) Field of Classification Search ..... 340/438
See application file for complete search history.

(56) References Cited

U.S. PATENT DOCUMENTS 5,530,420 A * 6/1996 Tsuchiya et al. ..... 340/435
5,680,123 A * 10/1997 Lee ..... 340/937

FOREIGN PATENT DOCUMENTS

| | | | |
|---|---|---|---|
| JP | 6-257189 | A | 9/1994 |
| JP | 9-151491 | A | 6/1997 |
| JP | 2002-201676 | A | 7/2002 |
| JP | 2002-294762 | | 10/2002 |
| JP | 2002-294765 | A | 10/2002 |
| JP | 2002-371594 | A | 12/2002 |
| JP | 2004-308137 | | 11/2004 |

OTHER PUBLICATIONS

PCT/JP2004/018804 International Search Report; Mar. 22, 2005.
PCT/JP2004/018804 IPRP (English Translation); Unknown.

* cited by examiner

*Primary Examiner*—Donnie L Crosland
(74) *Attorney, Agent, or Firm*—Duane Morris LLP

(57) ABSTRACT

An indicator control system for switching from a measurement value display mode to a camera display mode and vice versa in order to display a selected mode on a monitor section of an indicator and for generating an alarm from an alarm section. The measurement value display mode shows the measurement data of an object to be monitored such as a construction machine. The camera display mode being for a camera section that is mounted on the construction machine.

7 Claims, 4 Drawing Sheets

INDICATOR CONTROL SYSTEM FOR CONSTRUTION MACHINE

TECHNICAL FIELD

The present invention relates to an indicator control system for switching from a measurement value display mode to a camera display mode and vice versa to display a selected mode on a monitor section of an indicator and for generating an alarm from an alarm section, the measurement value display mode showing the measurement data of an object to be monitored of a construction machine, and the camera display mode being for a camera section mounted on the construction machine.

BACKGROUND ART

In the case where a monitoring camera is used as an auxiliary means for performing work using a construction machine safely and smoothly, it is necessary to provide a display for showing the image of the camera in a driver's cabin (for example, Japanese Patent Provisional Publication No. 2002-294762).

On the other hand, for an indicator of the construction machine, especially a hydraulic excavator, not only fuel and engine cooling water but also the temperature of hydraulic oil for driving the excavator must be monitored, and these measurement values are shown on a gage or a liquid crystal display of the indicator.

However, the space of the driver's cabin is limited, so that a problem arises in that a display for showing camera images provided separately from the gage and the indicator obstructs the front field of vision.

Also, even in the case where alarm information is shown on a separate monitor for monitoring the equipment information, a problem arises in that it is difficult for the operator to become aware of the alarm information when he/she is paying attention to the display for camera.

Accordingly, Japanese Patent Provisional Publication No. 2002-371594 has disclosed a configuration in which switching from a first mode for showing an image from a rear monitoring camera on a single monitor screen to a second mode for showing a vehicle body state on the monitor screen and vice versa can be performed, and this switching operation is performed by the operation of a running operation means, by which the monitor screen is used in common.

However, alarm information generally appears on the screen for displaying the equipment information. Therefore, in a state in which the monitor screen is switched to the first mode, the operator who is paying attention to the monitor screen showing the image from the monitoring camera cannot immediately recognize the occurrence of abnormality of equipment, which poses a safety problem. Patent Document 1: Japanese Patent Provisional Publication No. 2002-371594 Refer to FIG. 4

DISCLOSURE OF THE INVENTION

Problems to be Solved by the Invention

A problem to be solved by the present invention is to provide an indicator control system for a construction machine, in which a monitor section of an indicator can be switched from a measurement value display mode for showing the measurement data of an object to be monitored of the construction machine to a camera display mode for showing an image picked up by a camera and vice versa, and an alarm can be generated from an alarm section regardless of the display mode when it is judged, based on the measurement data, that the alarm is necessary.

Means for Solving the Problems

To solve the above problem, the present invention provides an indicator control system for a construction machine, including an indicator for switching, by a switching means, from a measurement value display mode for showing measurement data of an object to be monitored of the construction machine to a camera display mode of a camera section mounted on the construction machine and vice versa and for displaying a selected mode on a monitor section; an alarm section for generating an alarm, which is provided at a place different from the monitor section on the indicator; an alarm judging means for judging whether or not the measurement data of the object to be monitored corresponds to a predetermined alarm standard; and an alarm control means for activating the alarm section to generate an alarm regardless of the display mode shown on the monitor section when the alarm judging means judges that the alarm is necessary.

Also, the configuration may be such that the indicator be constructed so that the alarm section is provided at an upper part of a housing, the liquid crystal monitor section is formed in a center of the housing, and a control panel section is provided in a lower part of the housing, and the monitor section consist of a liquid crystal screen, and include a gage image display section for showing a measurement value of the object to be monitored, a character display section for showing numerical values and the like, and an event display section for showing alarm contents and various pieces of equipment information.

The alarm control means preferably has an alarm judging means for judging whether or not image data sent from the camera section corresponds to a predetermined alarm standard.

The configuration may be such that an alarm pattern corresponding to the display mode of the monitor section is determined in advance, and when the alarm judging means judges that an alarm is necessary, the alarm control means selects the alarm pattern corresponding to the display mode shown on the monitor section to activate the alarm section.

Also, the alarm section may consist of an alarm lamp formed by a light source such as an LED provided on the housing of indicator.

Effect of the Invention

In the indicator control system for a construction machine in accordance with the present invention, since the measurement value display mode and the camera display mode can be displayed on one indicator by being switched, the space in a cab can be saved, and also good front visibility can be secured.

Also, since the indicator is provided with the alarm section separately from the display section, the operator has only to distribute his/her attention to the display section and the alarm section. Even in the case where the indicator is in the camera display mode and the operator is watching the screen carefully, the operator becomes easily aware of an alarm and can take a safety action without delay.

EXPLANATION OF SYMBOLS

Figure 1:
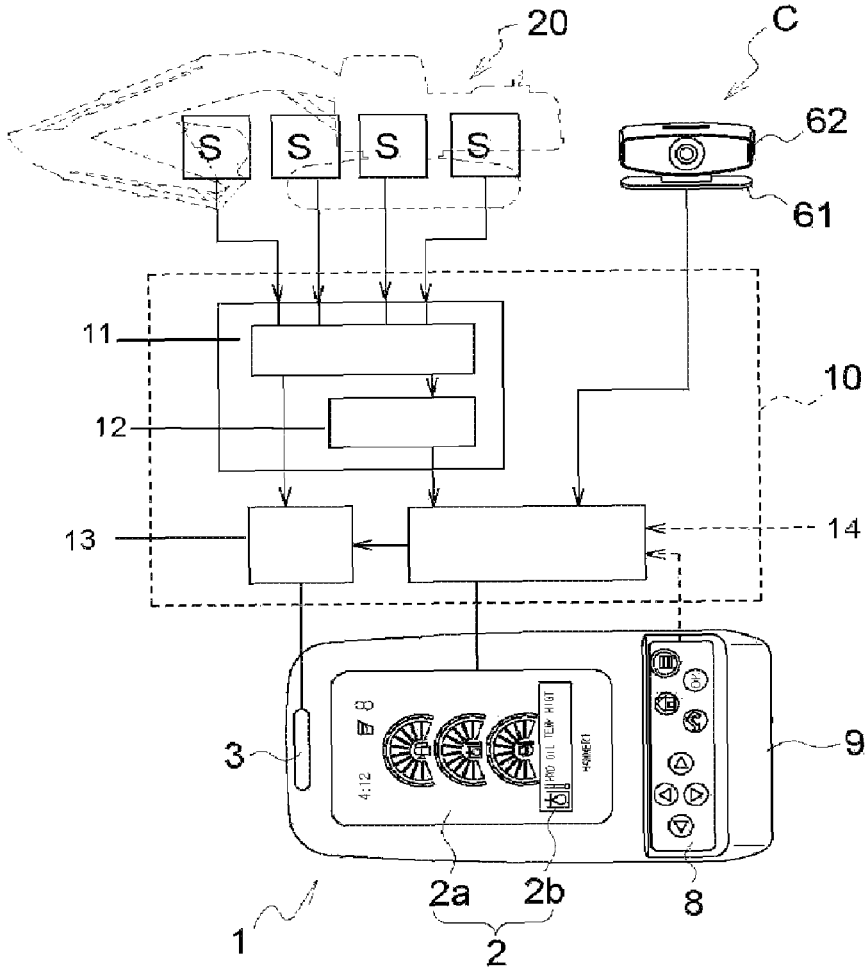
FIG. 1 is a block diagram of an indicator control system for a construction machine in accordance with example 1.

1 . . . indicator
2 . . . monitor section
2*a* . . . gage image display section
2*b* . . . event display section
3 . . . alarm section
4 . . . fuel gage
5 . . . oil temperature gage
6 . . . water temperature gage
8 . . . control panel section
10 . . . controller
11 . . . alarm judging means
11' . . . camera alarm judging means
12 . . . image processing means
13 . . . alarm control means
14 . . . input switching means
20 . . . hydraulic excavator
C . . . camera section
S . . . sensor

BEST MODE FOR CARRYING OUT THE INVENTION

A preferred embodiment in the case where an indicator control system for a construction machine in accordance with the present invention is applied to a hydraulic excavator will now be described with reference to the accompanying drawings.

EXAMPLE 1

An indicator control system shown in FIG. 1 includes indicator 1 provided in a cab, a sensor group S, S, S . . . which is provided on predetermined components of a hydraulic excavator 20 to obtain measurement data, a monitoring camera C mounted at a predetermined location of the hydraulic excavator 20, and a controller 10 which allows images to be displayed in a monitor section 2 of the indicator 1 based on the measurement data to control the activation of an alarm section 3.

In the case of this example, the controller 10 includes an alarm judging means 11 for judging whether or not the measurement data from the sensor group S, S, S . . . corresponds to a preset alarm standard (in other words, whether or not the measurement data is included in the normal region), an image processing means 12 for converting the measurement data into a gage image, an alarm control means 13 for determining a pattern control of alarm to the alarm section 3, and an input switching means 14 for determining an image input to the monitor section 2 (and also for sending the determined display mode to the alarm control means).

[Hydraulic Excavator]

Figure 2:
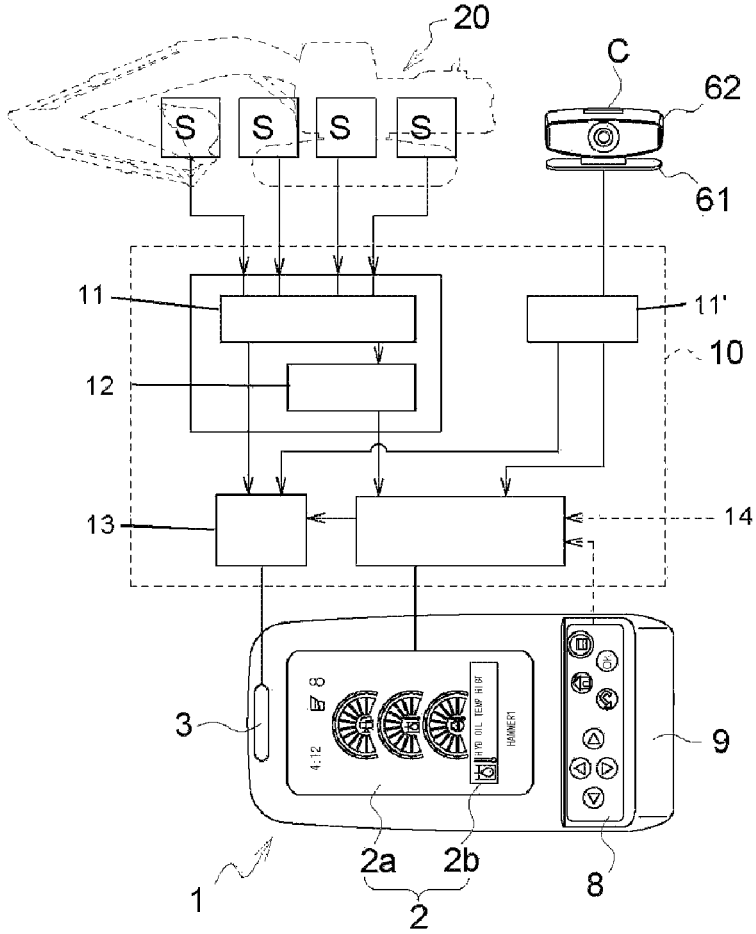
FIG. 2 is a side view showing one example of an installation position of a camera section of a hydraulic excavator.

A general configuration of the hydraulic excavator 20, which is shown as one example of work equipment, is shown in FIG. 2.

The hydraulic excavator 20 has a general configuration in which an upper swinging body 22 is provided on a lower running body 21 so as to be capable of swinging, and the upper swinging body 22 is mounted with a power system section 23 including an engine, a hydraulic pump driven by the engine, and the like, a hydraulic control section, not shown, for controlling a hydraulic circuit connected to the hydraulic pump, a cab 24 serving as an operator's room, and a work attachment 25.

For the work attachment 25, in a tip end portion of a boom 27 turned by a hydraulic cylinder 26 for boom, an arm 29 turned by a hydraulic cylinder 28 for arm is pivotally supported, and in a tip end portion of the arm 29, a bucket 33 turned by a hydraulic cylinder 31 for bucket via a linkage 32 is pivotally supported.

[Indicator]

Figure 3:
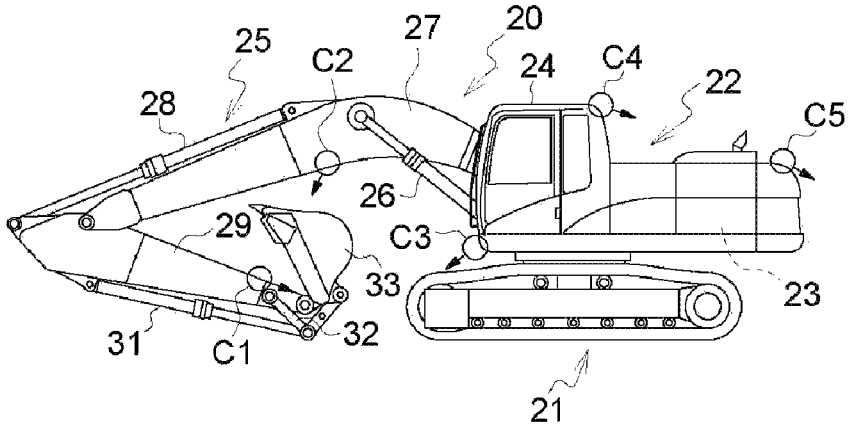
FIG. 3 is a perspective view showing one example of an arrangement of a display in a cab.

The indicator 1 is disposed at an appropriate location in the cab 24; in one example shown in FIG. 3, it is disposed at one side of running control levers 35 which are provided in front of a seat 34.

Figure 4:
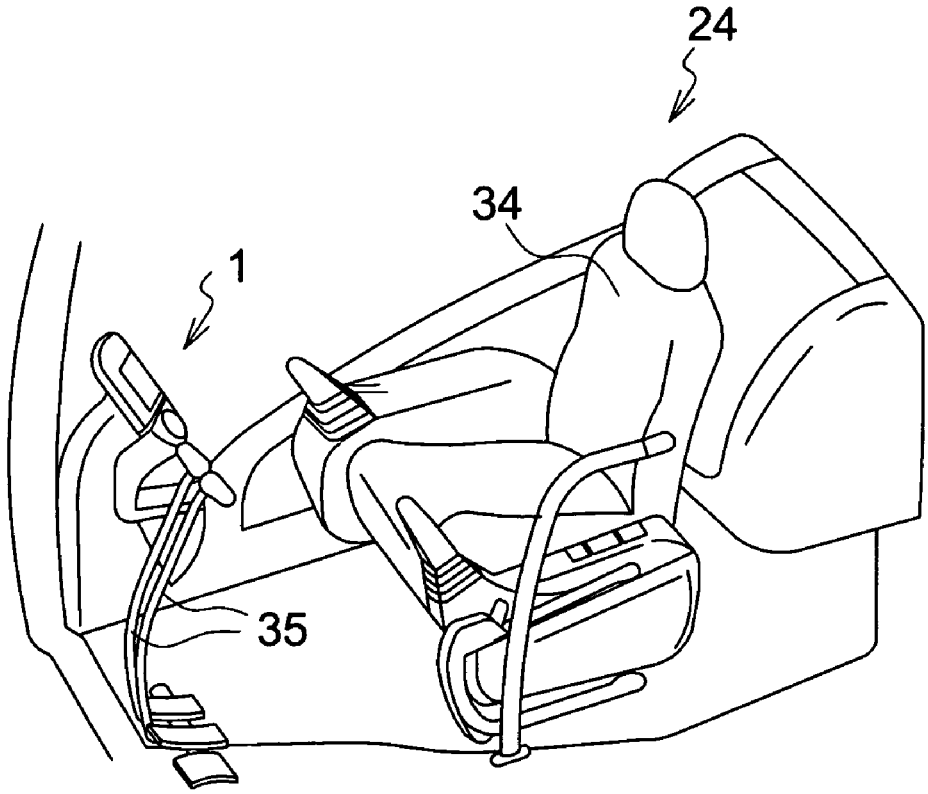
FIG. 4 is a front view of an indicator.

In this example, as shown in FIGS. 1 and 4, the indicator 1 is configured so that the alarm section 3 consisting of a red lamp incorporating a light source such as an LED is provided at an upper part of a housing 1A, the liquid crystal monitor section 2 is formed in the center thereof, and a control panel section 8 is provided at a lower part thereof.

The alarm section 3 generates an alarm by turning on or turning on and off the light source such as an LED according to a predetermined alarm pattern.

In the present invention, the alarm section 3 is not limited to an LED, and any other publicly known light source such as an electric lamp can be used.

[Monitor Section]

In the case of the example shown in the figures, the monitor section 2 is a liquid crystal screen provided with a gage image display section 2*a* for showing the measurement values of objects to be monitored, such as a fuel gage 4 for showing the remaining amount of engine fuel, an oil temperature gage 5 for showing the oil temperature of hydraulic oil in the hydraulic circuit, a water temperature gage 6 for showing water temperature of engine cooling water, and the like; a character display section 7 for showing numerical values and the like; and an event display section 2*b* for showing alarm contents and various pieces of equipment information with icons and characters. The fuel gage 4, the oil temperature gage 5, and the water temperature gage 6 each consist of a full-graphic liquid crystal display using a liquid crystal/LED (Light Emitting Diode).

The fuel gage 4, the oil temperature gage 5, and the water temperature gage 6 each include a symbol icon 4*a*, 5*a*, 6*a*, a display section 4*b*, 5*b*, 6*b* arranged so as to surround the symbol icon 4*a*, 5*a*, 6*a* to graphically show a real-time measurement value (remaining fuel amount, water temperature, oil temperature), and an alarm region display section 4*c*, 5*c*, 6*c* provided on the outside along the display section 4*b*, 5*b*, 6*b*.

The symbol icon 4*a*, 5*a*, 6*a* is a fixedly-shaped mark, and the current value display section 4*b*, 5*b*, 6*b* is configured so that a plurality of liquid crystal segments are arranged in an arcuate form, by which the liquid crystal segments of the number corresponding to the current measurement value (remaining fuel amount, water temperature, oil temperature) are displayed by coloring.

On the other hand, the control panel section 8 of the indicator 1 is provided, as one example of key input means, an upper arrow mark key 81, a lower arrow mark key 82, a left arrow mark key 83, a right arrow mark key 84, a menu key 85, a set key 86, an OK key 87, a cancel key 88, and the like.

Also, in a lower end portion of the indicator body, a cover body 9 is provided so as to be opened and closed freely via a hinge portion, and covers and protects the control panel section 8 when the control panel section 8 is not in use.

Such a configuration corresponds to the configuration of the indicator shown in Japanese Patent Application No. 2003-99485.

[Camera Section]

The monitoring camera section C consists of, for example, a 6D camera. In the example shown in the figures, the camera section C is constructed so that a camera body (housing) 62 is provided on a mounting base 61 so that the angle is adjustable.

One or a plurality of camera sections C can be mounted at appropriate locations according the work content of the hydraulic excavator 20.

One example of mounting locations is shown in FIG. 2. As exemplarily shown in FIG. 2, the mounting locations are C1 on the tip end side of the arm 29, C2 at an intermediate position of the boom 27, C3 in front of the lower end of the upper swinging body 22, C4 in an upper part at the rear of the cab 24, C5 in an upper part of a counterweight, and the like. In FIG. 2, a location indicated by a circle mark shows the location at which the camera section is mounted, and the direction indicated by an arrow mark shows the photographing direction. In the present invention, the mounting position of the camera section is not subject to any special restriction, and the number of camera sections mounted at one location is not limited to one, and a plurality of camera sections can be mounted at one location.

Thus, the position in a blind spot of operator and the work state of work attachment can be caught by the camera section.

The camera section C may be in a state in which the switch is always turned on or may be controlled so that the switch is turned on manually or automatically by a predetermined equipment operation of the operator.

The image data photographed by this camera section C is sent to an image input section of the indicator 1 via the input switching means 14 by a wire system or a wireless system.

[Alarm Judging Means]

The alarm judging means 11 converts the detection data from the sensor group S, S, S . . . into a measurement value. Alternatively, in the case where the measurement value can be obtained directly from the sensor, the alarm judging means 11 receives the measurement value as it is, and compares it with preset alarm standard data, thereby judging whether or not an alarm is necessary.

The measurement value subjected to the judgement is converted into the gage image shown on the monitor section 2 or the alarm image by the image processing means 12, or an event display, described later, shown on the event section 2*b* is called out and is shown as the image data.

[Alarm Control Means]

The alarm control means 13 receives the result of the alarm judging means 11 and the current display mode of the input switching means 14, described later, and determines the presence or absence of activation of the alarm section 3 and the alarm pattern in the case of activation.

[Input Switching Means]

The input switching means 14 selectively performs switching between a measurement display mode sent from the image processing means and a camera display mode sent from the camera section, and displays one selected display mode on the monitor section.

As the switching mechanism therefor, there are available a system in which the current display mode is switched by manual operation of operator and a system in which the current display mode switches automatically in association with the operation of predetermined equipment.

In the former case, for example, a screen selector switch (not shown) provided on the indicator 1 or the existing key is provided with a selector switch function, and by pressing the switch or the key, the current display mode on the monitor section 2 is switched.

In the latter case, if the preset equipment performs a predetermined operation, the switching mechanism is activated in association with the operation, by which the current display mode is switched.

The predetermined operation of the equipment may be set by the teaching system in which the operation is set freely (registered in the memory) in advance according to the taste of the user (or the operator) or the use conditions at the time of work, or may be set in the same manner by the selection from the preset operation patterns of the predetermined equipment that has been preset.

The kind of the display mode selected by the input switching means 14 is fed back to the alarm control means 13.

[Event Display and Alarm Pattern]

In this example, a different alarm pattern is generated between the case where the display mode of the indicator 1 is the measurement value display mode and the case where it is the camera display mode.

As one example, in the case of the measurement value display mode, the alarm pattern is a pattern in which the LED is turned on and off in one second cycle, and in the case of the camera display mode, the alarm pattern consists of four kinds of (1) turned on, (2) turned on and off in 0.5 second cycle, (3) turned on and off in 1 second cycle, and (4) turned on and off in 2 second cycle.

Thereupon, the alarm patterns in each mode according to the event display are exemplarily shown below.

(1) In the case where it is detected that the level of hydraulic oil becomes lower than a predetermined value or in the case where the temperature of hydraulic oil increases exceeding a predetermined value.

(a) In the measurement value display mode, the background of the event display section 2*b* assumes a red color, and an icon corresponding thereto and characters "HYD LEVEL LOW"and characters "HYD TEMP HIGH" are displayed on the background. Together with this display, the alarm section 3 generates an alarm of turning on and off in 1 second cycle.

(b) In the camera display mode, the monitor section 2 still displays the camera display mode (no display on the event display section 2*b*), and the alarm section 3 continues to turn on.

(2) In the case where abnormality of battery voltage is detected.

(a) In the measurement value display mode, the background of the event display section 2*b* assumes a red color, and an icon corresponding thereto and characters "BATTERY VOLTAGE IRREGULAR" are displayed on the background, but the alarm section 3 is still turned off.

(b) In the camera display mode, the monitor section 2 still displays the camera display mode, and the alarm section 3 turns on and off in 0.5 second cycle.

(3) In the case where it is detected that the level of fuel becomes lower than a predetermined value.

(a) In the measurement value display mode, the background of the event display section 2*b* assumes an orange color, and an icon corresponding thereto and characters "FUEL LEVEL LOW" are displayed on the background, but the alarm section 3 is still turned off.

(b) In the camera display mode, the monitor section 2 still displays the camera display mode, and the alarm section 3 turns on and off in 1 second cycle.

(4) In the case where it is detected that the supply of lubricating oil starts.

(a) In the measurement value display mode, the background of the event display section 2*b* assumes a green color, and an icon corresponding thereto and characters "LUBE STARTING" are displayed on the background, but the alarm section 3 is still turned off.

(b) In the camera display mode, the monitor section 2 still displays the camera display mode, and the alarm section 3 turns on and off in 2 second cycle.

As described above, the alarm pattern of the alarm section 3 can be displayed by being changed between the measurement value display mode and the camera display mode according to the situation of equipment. Therefore, even if the monitor section 2 displays the camera display mode, the operator becomes aware of the alarm, and hence can take measures, for example, can switch the display mode to the measurement value display mode to know abnormality well in advance.

In the above-described example, the case where the alarm pattern is changed between the measurement value display mode and the camera display mode based on the same alarm standard is shown. However, the alarm standard itself may be set separately in the measurement value display mode and the camera display mode.

Also, in the above-described example, whether or not the alarm is necessary is judged from the measurement value of the object to be monitored that can be displayed on the indicator 1. However, whether or not the alarm is necessary may be judged on the basis of the measurement value of an object not to be displayed on the indicator, and an alarm may be generated.

EXAMPLE 2

Also, in the above-described example, the configuration in which whether or not the alarm is necessary is not judged from the data of the camera section C is exemplarily shown. However, the configuration may be such that whether or not the alarm is necessary is judged based on the data of the camera section C.

The configuration may be such that, for example, during the work, the camera section C is allowed to be activated always or during predetermined work, and when an obstacle is detected in a predetermined monitoring area displayed on the camera section C, whether or not the alarm is necessary is judged by a camera alarm judging means 11', and an alarm is generated in the same way.

Figure 5:
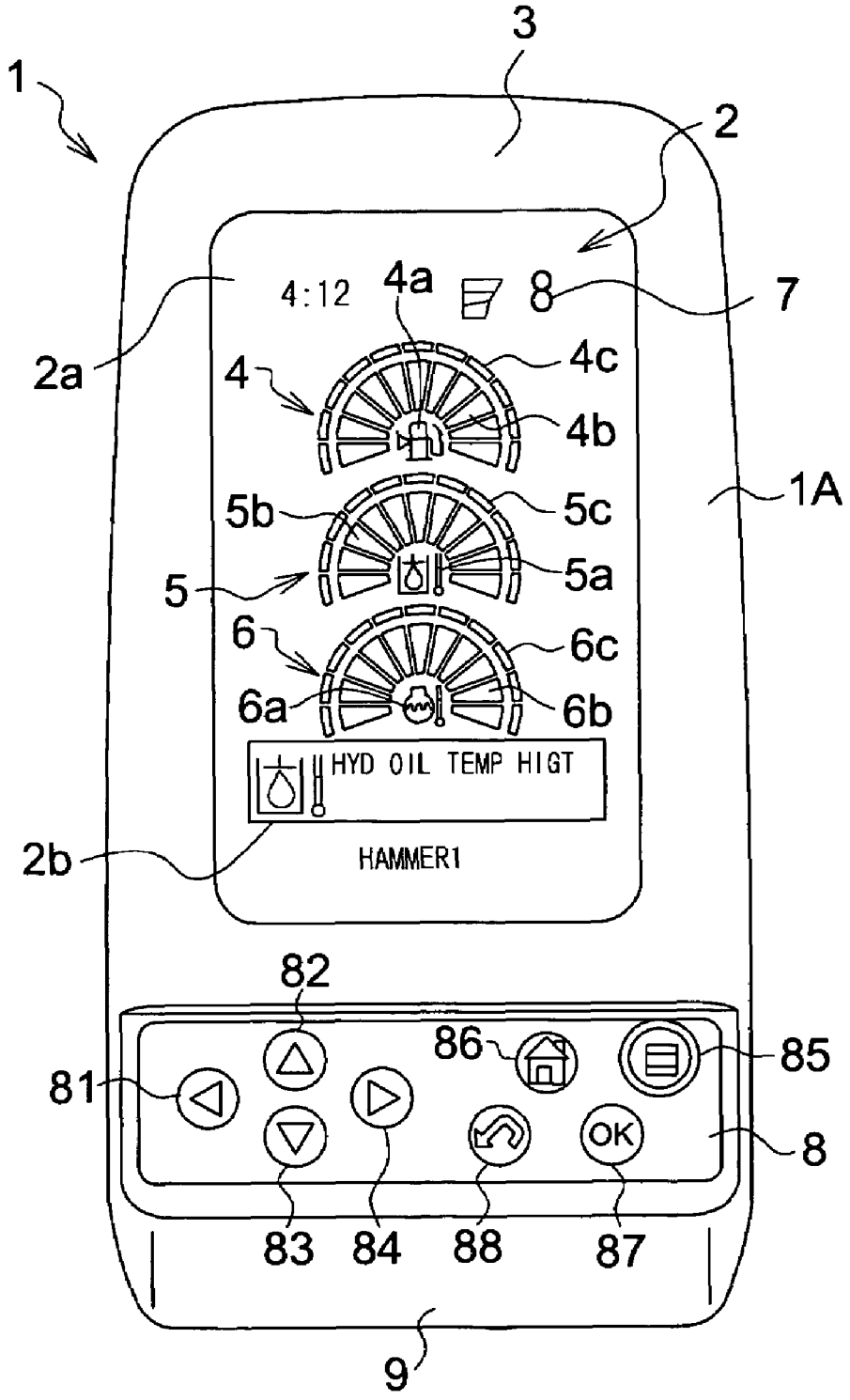
FIG. 5 is a block diagram of an indicator control system for a construction machine in accordance with example 2.

In the indicator control system shown in FIG. 5, the image data of the camera section C is sent to the camera alarm judging means 11', and it is judged whether or not the obstacle displayed on the image data is safe.

When it is judged that an alarm is necessary, the data is sent to the alarm control means 13 and controls the alarm section 3, by which an alarm is generated with a predetermined alarm pattern.

In this case as well, the alarm pattern can be made different between the case where the monitor section 2 is in the camera display mode and the case where it is in the measurement value display mode.

Also, in the case where the monitor section 2 is in the measurement value display mode, a message such as "OBSTACLE IS PRESENT IN SWIRL AREA" may be displayed on the event display section 2*b*.

Other configurations are the same as those of the above-described first example, so that the explanation thereof is omitted.

In the above-described examples, the configuration in which the alarm section consists of an alarm lamp has been shown. However, the configuration may be such that a voice alarm is generated or a voice alarm is generated together with the alarm lamp.

In addition, it is a matter of course that various design changes can be made without departing from the spirit and scope of the present invention.

INDUSTRIAL APPLICABILITY

In the above-described examples, the hydraulic excavator is exemplarily shown as one example of construction machine. However, the present invention can be applied to a construction machine having any other work attachment, such as a wheel loader or a bulldozer.

The invention claimed is:

1. An indicator control system for a construction machine, comprising:

an indicator for switching, by a switching means, from a measurement value display mode for showing measurement data of an object to be monitored of the construction machine to a camera display mode of a camera section mounted on the construction machine and vice versa and for displaying a selected mode on a monitor section;

an alarm section for generating an alarm, which is provided at a place different from the monitor section on the indicator;

an alarm judging means for judging whether or not measurement data of the object to be monitored corresponds to a predetermined alarm standard; and an alarm control means for activating the alarm section to generate an alarm regardless of the display mode shown on the monitor section when the alarm judging means judges that the alarm is necessary.

2. The indicator control system for a construction machine according to claim 1, characterized in that the indicator is constructed so that the alarm section is provided at an upper part of a housing, the liquid crystal monitor section is formed in a center of the housing, and a control panel section is provided in a lower part of the housing, and the monitor section consists of a liquid crystal screen, and includes a gage image display section for showing a measurement value of the object to be monitored, a character display section for showing numerical values and the like, and an event display section for showing alarm contents and various pieces of equipment information.

3. The indicator control system for a construction machine according to claims 1 or 2, characterized in that the alarm control means has an alarm judging means for judging whether or not image data sent from the camera section corresponds to a predetermined alarm standard.

4. The indicator control system for a construction machine according to claim 1, characterized in that an alarm pattern corresponding to the display mode of the monitor section is determined in advance, and when the alarm judging means judges that an alarm is necessary, the alarm control means selects the alarm pattern corresponding to the display mode shown on the monitor section to activate the alarm section.

5. The indicator control system for a construction machine according to claim 1, characterized in that the alarm section consists of an alarm lamp formed by a light source such as an LED provided on the housing of indicator.

6. The indicator control system for a construction machine according to claim 2, characterized in that an alarm pattern corresponding to the display mode of the monitor section is determined in advance, and when the alarm judging means judges that an alarm is necessary, the alarm control means selects the alarm pattern corresponding to the display mode shown on the monitor section to activate the alarm section.

7. The indicator control system for a construction machine according to claim 3, characterized in that an alarm pattern corresponding to the display mode of the monitor section is determined in advance, and when the alarm judging means judges that an alarm is necessary, the alarm control means selects the alarm pattern corresponding to the display mode shown on the monitor section to activate the alarm section.

* * * * *

UNITED STATES PATENT AND TRADEMARK OFFICE

CERTIFICATE OF CORRECTION

PATENT NO. : 7,626,491 B2
APPLICATION NO. : 10/584391
DATED : December 1, 2009
INVENTOR(S) : Yamada et al.

It is certified that error appears in the above-identified patent and that said Letters Patent is hereby corrected as shown below:

On the title page item (54), and col. 1, line 2, delete "CONSTRUTION" and replace with --CONSTRUCTION--.

Signed and Sealed this

Sixteenth Day of March, 2010

David J. Kappos

David J. Kappos
*Director of the United States Patent and Trademark Office*